US007122756B2

(12) United States Patent
Sasaki et al.

(10) Patent No.: US 7,122,756 B2
(45) Date of Patent: Oct. 17, 2006

(54) PUSH SWITCH

(75) Inventors: Atsumi Sasaki, Tokyo (JP); Toshiharu Mori, Tokyo (JP); Kenji Sawada, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/167,762

(22) Filed: Jun. 27, 2005

(65) Prior Publication Data

US 2006/0000699 A1 Jan. 5, 2006

(30) Foreign Application Priority Data

Jul. 1, 2004 (JP) ..... 2004-195664
Jul. 1, 2004 (JP) ..... 2004-195675

(51) Int. Cl.
*H01H 13/00* (2006.01)
*H01H 1/36* (2006.01)
*H01H 3/42* (2006.01)
*H01H 9/18* (2006.01)

(52) U.S. Cl. ..... 200/520; 200/524; 200/536; 200/314; 200/16 C

(58) Field of Classification Search ..... 200/520–525, 200/530–532, 536, 310–314, 341–345, 16 R–16 D, 200/296
See application file for complete search history.

(56) References Cited

U.S. PATENT DOCUMENTS 4,467,159 A * 8/1984 Ota et al. ..... 200/524
4,704,503 A * 11/1987 Takasawa ..... 200/16 B
4,891,475 A * 1/1990 Wiersing et al. ..... 200/5 R
4,897,513 A 1/1990 Oka et al.
4,956,529 A * 9/1990 Ueno ..... 200/524
5,898,142 A * 4/1999 Ohtaki et al. ..... 200/16 C
6,610,939 B1 * 8/2003 Watada ..... 200/16 D
6,743,993 B1 * 6/2004 Clark et al. ..... 200/314
6,747,226 B1 * 6/2004 Watanabe ..... 200/520
2003/0026941 A1 2/2003 Togawa et al.

FOREIGN PATENT DOCUMENTS

JP 63-168932 11/1988
JP 1-135620 9/1989
JP 2001-229779 8/2001

* cited by examiner

*Primary Examiner*—Michael A. Friedhofer
(74) *Attorney, Agent, or Firm*—Brinks Hofer Gilson & Lione

(57) ABSTRACT

A push switch includes an operating body, a case, a return spring, and a light source. The operating body is controlled by push operation, includes a through-hole in the center and a display portion at the upper edge of the through-hole, and supports a movable contact unit. The case has the insert hole on a bottom surface opposing the through-hole and fixed contact units on an inner surface of the sidewall. The movable contact unit comes into contact with fixed contact units. The return spring is interposed between the case and the operating body and returns the position of the operating body in the reverse direction of the push operation. The light source stored in the insert hole and the through-hole. The through-hole is formed linearly in the direction the operating body is moved during the push operation so that the light source does not interfere with the operating body.

8 Claims, 10 Drawing Sheets

PUSH SWITCH

This application claims the benefit of priority to Japanese Patent Application Nos. 2004-195664 and 2004-195675, filed on Jul. 1, 2004, both herein incorporated by reference.

BACKGROUND OF THE INVENTION

1. Field of the Invention

The present invention relates to a push switch including a light-illuminating structure for a lockout of a power window. More specifically, the present invention relates to a push switch having a fixed contact unit on the inner surface of a case and a movable contact unit that comes into contact with and separates from the fixed contact unit on an operation shaft.

2. Description of the Related Art

The structure of a first known push switch including a light-illuminating structure described in Japanese Unexamined Patent Application Publication No. 63-168932 is illustrated in FIG. 9.

As illustrated in the drawing, the push switch includes a push button 21 having a transparent display portion on the front surface, a non-transparent escutcheon 23 having a button hole 22 for passing through the push button 21, a non-transparent printed circuit board 25 being disposed on the back side of the escutcheon 23 and having a switch 24 operated by the push button 21 on the front side, a light-guiding portion 26 extending from the back of the push button 21 and being passed through a hole on the printed circuit board 25 formed behind the push button 21, and a light source 27 disposed on the back side of the printed circuit board 25.

The known push switch has a structure that guides light from the light source 27 that is disposed outside the push button 21 to the push button 21 to be operated, and the usability of light is low.

Since a long light-guiding portion 26 has to be formed as a single piece with the push button 21, the production cost per component unit is expensive.

Moreover, since the light source 27 is disposed on the side of the lower portion of the light-guiding portion 26, the diameter of the push switch has to be large when viewed from above to sufficiently illuminate the display portion.

In a push switch according to an embodiment of the present invention, the display portion and the light source are disposed close to each other. In this way, the display portion can be efficiently illuminated and the diameter of the push switch can be reduced.

A second known push switch is disclosed in Japanese Unexamined Patent Application Publication No. 2003-51225 and is illustrated in FIGS. 12 and 13.

As illustrated in the drawings, a case 31 includes sidewalls 31*a*, a rear wall 31*b*, and opening ends 31*c*. A pair of depressions 31*d* and a pair of protrusions 31*e* are provided on one of the sidewalls 31*a* close to the opening ends 31*c*.

A fixed contact unit 32 includes flat bases 32*a*, holes 32*b* formed substantially in the center of the bases 32*a*, fixed contacts 32*c* extending perpendicularly from one end of the bases 32*a*, and terminals 32*d* extending perpendicularly from the other end of the bases 32*a*.

The fixed contact unit 32 is mounted by passing the protrusions 31*e* of the case 31 through the holes 32*b* and aligning the bases 32*a* in the depressions 31*d* by thermal caulking.

A return spring 33, which may be a coil spring, is disposed in a manner such that one of the ends urges the rear wall 31*b* inside the case 31.

A movable unit 34 includes a base 34*a* and a prism-shaped operation shaft 34*b* that protrudes outwards from a front wall 34*c* of the base 34*a*. The base 34*a* includes the front wall 34*c*, a rear wall 34*d*, a first sidewall 34*e*, a second sidewall 34*f*, and a third sidewall 34*g*. A circular hole 34*h* is formed substantially in the center of the third sidewall 34*g*. The base 34*a* has a space (not shown in the drawings) defined by the front wall 34*c*, the rear wall 34*d*, and the first, second, and third sidewalls 34*e*, 34*f*, and 34*g*. The operation shaft 34*b* includes a pair of first side surfaces 34*q*, a pair of second side surfaces 34*j*, a pair of engagement protrusions 34*k*, supports 34*m* including four projections, and a tip 34*n*.

The base 34*a* of the movable unit 34 is disposed inside the case 31. At this time, the return spring 33 is interposed between the space (not shown in the drawings) of the base 34*a* and the rear wall 31*b* of the case 31. The movable unit 34 is urged by the resilient force of the return spring 33 in the axial direction of the movable unit 34.

A first end of a driving member 35 is attached to one of the sidewalls 31*a* of the case 31. A second end of the driving member 35 is passed through the sidewall 31*a* of which the first end is attached to and is attached to the second sidewall 34*f* of the movable unit 34. At this time, a heart cam (not shown in the drawings) is provided on the second sidewall 34*f* where the second end of the driving member 35 is provided. The second end of the driving member 35 moves inside the heart cam. As a result of the movement of the driving member 35, the movable unit 34 moves along a predetermined trajectory.

A flat spring 36 is made of a resilient flat metal piece that is substantially L-shaped. The flat spring 36 has an attachment portion 36*a* and a pressed portion 36*b* extending orthogonally from one of the ends of the attachment portion 36*a*. The pressed portion 36*b* is disposed in a manner such that the pressed portion 36*b* urges the driving member 35 toward the sidewall 31*a*.

A resilient member 37, which may be a coil spring, is passed through and stored in the hole 34*h* of the third sidewall 34*g* of the movable unit 34.

A movable contact unit 38 includes a base 38*a*, two substantially oval movable contacts 38*b*, a pair of attachment portions 38*c* extending orthogonally from the outer edges of the base 38*a*, blades 38*d*, and guiding pieces 38*e*. A first end of the resilient member 37 is urged against the movable contact unit 38. The base 38a opposes the third sidewall 34*g* of the movable unit 34. At this time, the pair of attachment portions 38*c* is interposed between the front wall 34*c* and the rear wall 34*d*. In this way, the two movable contacts 38*b* are urged in a direction away from the third sidewall 34*g* of the movable unit 34 by the resilient force of the resilient member 37.

The two movable contacts 38*b* are urged against the fixed contacts 32*c* of the two fixed contact unit 32.

A knob 39 is made of synthetic resin and is formed by a coinjection molding process. The knob 39 includes an inner chassis 40 and an external chassis 41 covering the inner chassis 40. The inner chassis 40 and the external chassis 41 are formed as a single piece. The knob 39 is disposed in a manner such that the prism-shaped operation shaft 34*b* of the movable unit 34 is disposed inside a prism-shaped attachment portion 40*a* of the inner chassis 40. In this way, the knob 39 is attached to the movable unit 34. When the knob 39 is attached to the movable unit 34, the pair of engagement protrusions 34*k* of the movable unit 34 is latched to a pair of engagement holes 40*b* of the inner chassis 40 of the knob 39.

Next, the operation of the push switch is explained briefly. First, when the knob 39 is pressed down, the knob 39 and movable unit 34 are pushed downward against the resilient force of the return spring 33. In this way, a part of the movable unit 34 is pushed into the case 31. When the movable unit 34 is pushed into the case 31, the two movable contacts 38*b* of the movable contact unit 38 are urged against the fixed contacts 32*c* of the fixed contact unit 32. Accordingly, the push switch is turned on.

At this time, the driving member 35 moves along a predetermined trajectory in the heart cam (not shown in the drawings) provided on the second sidewall 34*f* of the movable unit 34. Subsequently, when the knob 39 is pushed in further, the knob 39 and the movable unit 34 are also pushed in further. Then, when the pressure on the knob 39 is released, the knob 39 and the movable unit 34 return to their original positions due to the resilient force of the return spring 33. Accordingly, the push switch is turned off.

In such a known push switch, the blades 38*d* are provided at both sides of the base 38*a* of the movable contact unit 38. These blades 38*d* slide through guiding grooves in the case 31. The guiding grooves have bumps at positions deeper inside the case 31. In this way, when the push switch is pushed down, the movable contacts 38*b* of the movable contact unit 38 are separated from the fixed contacts 32*c*. Consequently, the sliding life of the push switch can be extended.

However, because the blades 38*d* are provided at both sides of the base 38*a* of the movable contact unit 38, the size of the push switch in the movement direction of the movable unit 34 and the direction orthogonal to the movement direction cannot be reduced. As a result, the size of the push switch becomes large.

SUMMARY OF THE INVENTION

The push switch according to an embodiment of the present invention does not require blades on both sides of the base and the movable contacts can come into contact with and be separated from the fixed contacts by pushing down the operation shaft. As a result, the size of the push switch according to an embodiment of the present invention can be reduced.

A push switch according to an embodiment of the present invention includes an operating body, a case, a return spring, and a light source. The operating body is controlled by push operation, includes a through-hole in the center and a display portion at the upper edge of the through-hole, and supports a movable contact unit. The case has an insert hole on a bottom surface opposing the through-hole and fixed contact units on an inner surface of a sidewall. The movable contact unit comes into contact with fixed contact units. The return spring is interposed between the case and the operating body and returns the position of the operating body in the reverse direction of the push operation. The light source is stored in the insert hole and the through-hole. The through-hole is formed linearly in the direction the operating body is moved during the push operation so that the light source does not interfere with the operating body.

According to the push switch having the above-described structure, the display portion and the light source can be disposed close to each other. Since the light source may be disposed close to the display portion, the display portion can be efficiently illuminated.

According to the push switch according to an embodiment of the present invention, the case includes guiding protrusions in the periphery of the insert hole, a first end of the return spring is guided to the periphery of the guiding protrusions, and the operating body includes sidewalls defining the through-hole at the periphery of the return spring and a positioning unit for positioning a second end of the return spring in the through-hole.

In this way, the return spring can be guided easily. Since the return spring is stored in the through-hole of the operating body, the diameter of the push switch can be reduced.

The push switch having the above-described structure further includes a switch mechanism including the movable contact unit and the fixed contact unit provided on one of the sidewalls of the operating body and a push lock mechanism disposed on another one of the sidewalls of the operating body opposing the sidewalls including the fixed contact unit across the through-hole.

In this way, the size of the entire push switch can be reduced.

In the push switch according to the above-described embodiment, the fixed contact unit includes a pair of fixed contacts being disposed parallel to each other on the case and extending in the direction the operating body is moved during the push operation, the movable contact unit includes a pair of protruding movable contacts urged against the pair of fixed contacts by a resilient member, and the case includes a projection capable of separating the movable contacts from the fixed contacts by contacting the area between the protrusions when push operation is carried out so as to turn off the push switch.

Since the projection is capable of separating the movable contacts from the fixed contacts by contacting the area between the protrusions, the movable contacts can come into contact with or can be separate from the fixed contacts by pushing the operation shaft. Moreover, the size of the push switch can be reduced.

A push switch according to another embodiment of the present invention includes an operation shaft, a case, a movable contact unit, and a contact guiding portion. The operation shaft is capable of being reciprocated in the longitudinal direction when the push switch is pushed. The case includes a pair of fixed contacts extending parallel to each other in the push direction. The movable contact unit is supported by the operation shaft and includes a pair of protruding movable contacts being urged against the pair of fixed contacts by a resilient member. The contact guiding portion is capable of separating the movable contacts from the fixed contacts by contacting the area between the protrusions when the push operation is carried out so as to turn off the push switch.

In this way, since the movable contacts are separated from the fixed contacts by pushing the area between the protrusions, blades do not have to be provided and the movable contacts can come into contacted with or can be separated from the fixed contacts. Moreover, the size of the push switch can be reduced.

In the push switch according to an embodiment of the present invention, the resilient member pushes an area between the movable contacts.

In this way, when the entire movable contact unit is pushed by the resilient member, the movable contact unit cannot tilt as easily. Thus, there is a possibility in that an error in manufacturing may cause a difference in the height of the fixed contacts, causing the movable contacts not to be able to fully contact the fixed contacts. However, as in the push switch according to an embodiment of the present invention, by pushing the area between the movable contacts by the resilient member, or, more specifically, a coil spring having a small diameter, the movable contact unit can be easily tilted and the movable contacts can fully contact the fixed contacts.

When the movable contacts are at an off position, even if one of the movable contacts of the movable contact unit is in contact with one of the fixed contacts, the other movable contact will be separated from the other fixed contact wherein the contact guiding portion functions as a support point of the see-saw movement. In this way, the push switch is reliably turned off. At this time, bending load is not applied at the contact point of the movable contact unit and the contact guiding portion. Therefore, thickness of the movable contact unit may be reduced.

In the push switch according to an embodiment of the present invention, the resilient member pushes a point on the straight line connecting the movable contacts.

In this way, the length in the movement direction of the movable contacts can be reduced. Since the movable contacts are separated from the fixed contacts according to the shape of the contact guiding portion, the length in the movement direction can be reduced.

Accordingly, the push switch according to an embodiment of the present invention includes a display portion and a light source disposed closely to each other in a simple structure. Since the display portion can be disposed closely to the light source, the display portion can be illuminated efficiently.

The push switch according to an embodiment of the present invention can easily guide the coil spring. Furthermore, since the coil spring is stored in the through-hole in the operation body, the diameter of the push switch can be reduced.

The push switch according to an embodiment of the present invention includes a light-illuminating mechanism and a push lock mechanism while the size of the entire push switch can be reduced.

In the push switch according to an embodiment of the present invention, since the movable contacts are separated from the fixed contacts by contacting an area between a pair of protrusions, blades are not required. Moreover, the movable contacts can come into contacted with and can be separated from the fixed contact by push operating the operation shaft, and the size of the push switch can be reduced.

In the push switch according to an embodiment of the present invention, when the entire movable contact unit is pushed by the resilient member, the movable contact unit cannot tilt as easily. Thus, there is a possibility in that an error in manufacturing may cause a difference in the height of the fixed contacts, causing the movable contacts not to be able to fully contact the fixed contacts. However, as in the push switch according to an embodiment of the present invention, by pushing the area between the movable contacts by the resilient member, or more specifically a coil spring having a small diameter, the movable contact unit can be easily tilted and the movable contacts can fully contact the fixed contacts.

In the push switch according to an embodiment of the present invention, when the movable contacts are at an off position, even if one of the movable contacts of the movable contact unit is in contact with one of the fixed contacts, the other movable contact will be separated from the other fixed contact, wherein the contact guiding portion functions as a support point of the see-saw movement. In this way, the push switch is reliably turned off. At this time, bending load is not applied at the contact point of the movable contact unit and the contact guiding portion. Therefore, thickness of the movable contact unit may be reduced.

In the push switch according to an embodiment of the present invention, the length in the movement direction of the movable contacts can be reduced. Since the movable contacts are separated from the fixed contacts according to the shape of the contact guiding portion, the length in the movement direction can be reduced.

DESCRIPTION OF THE PREFERRED EMBODIMENTS

A push switch according to embodiments of the present invention will be described below with reference to the drawings.

Embodiments

Figure 1:
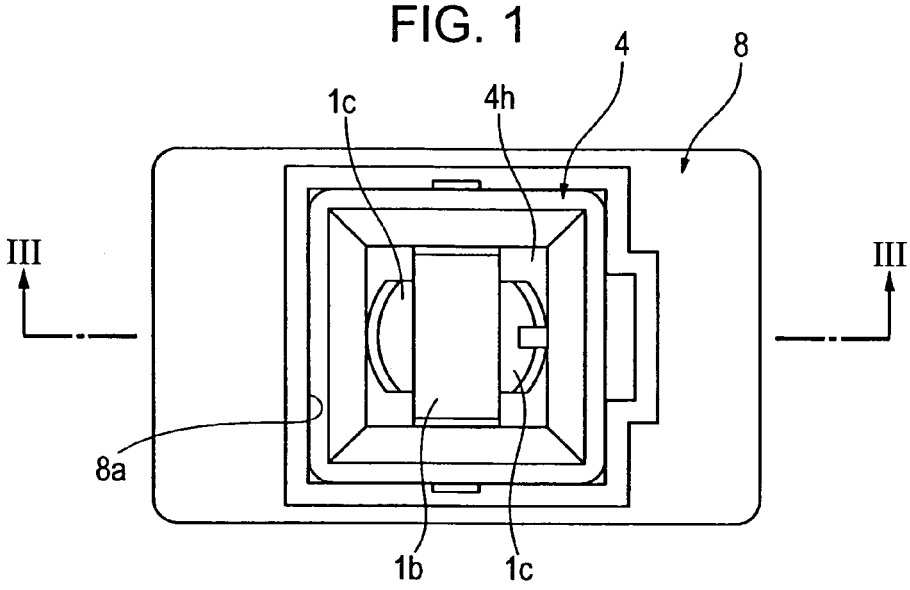
FIG. 1 is a plan view of a push switch according to an embodiment of the present invention.
Figure 2:
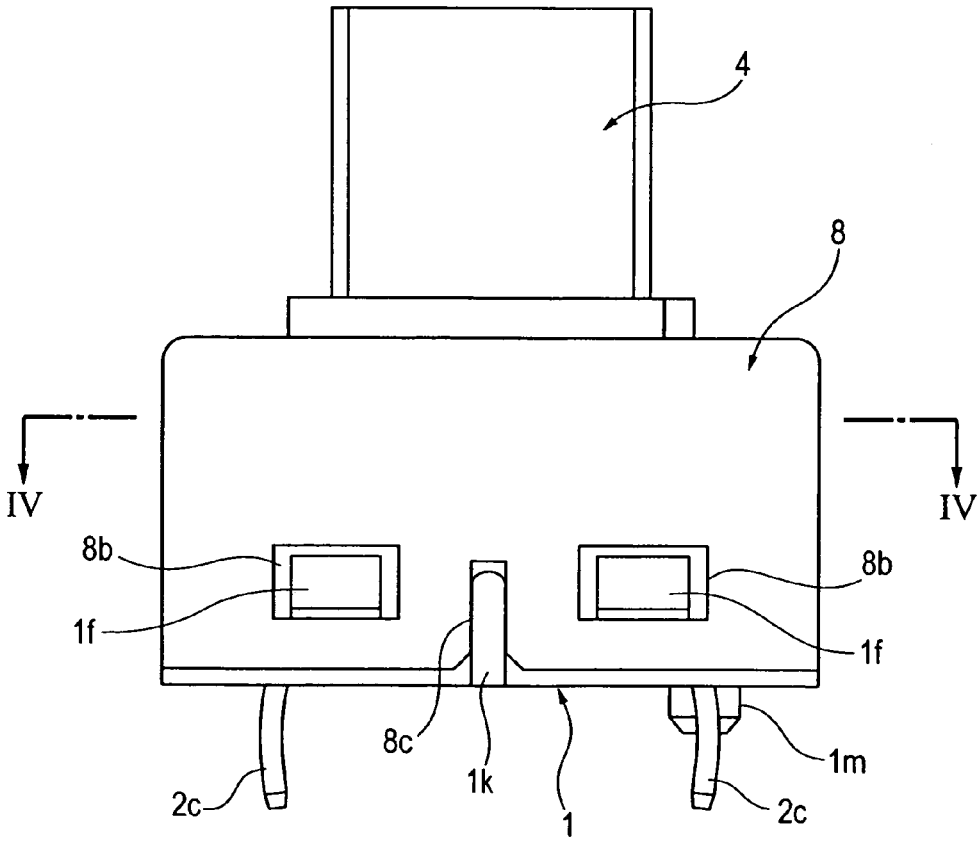
FIG. 2 is a front view of the push switch illustrated in FIG. 1.
Figure 3:
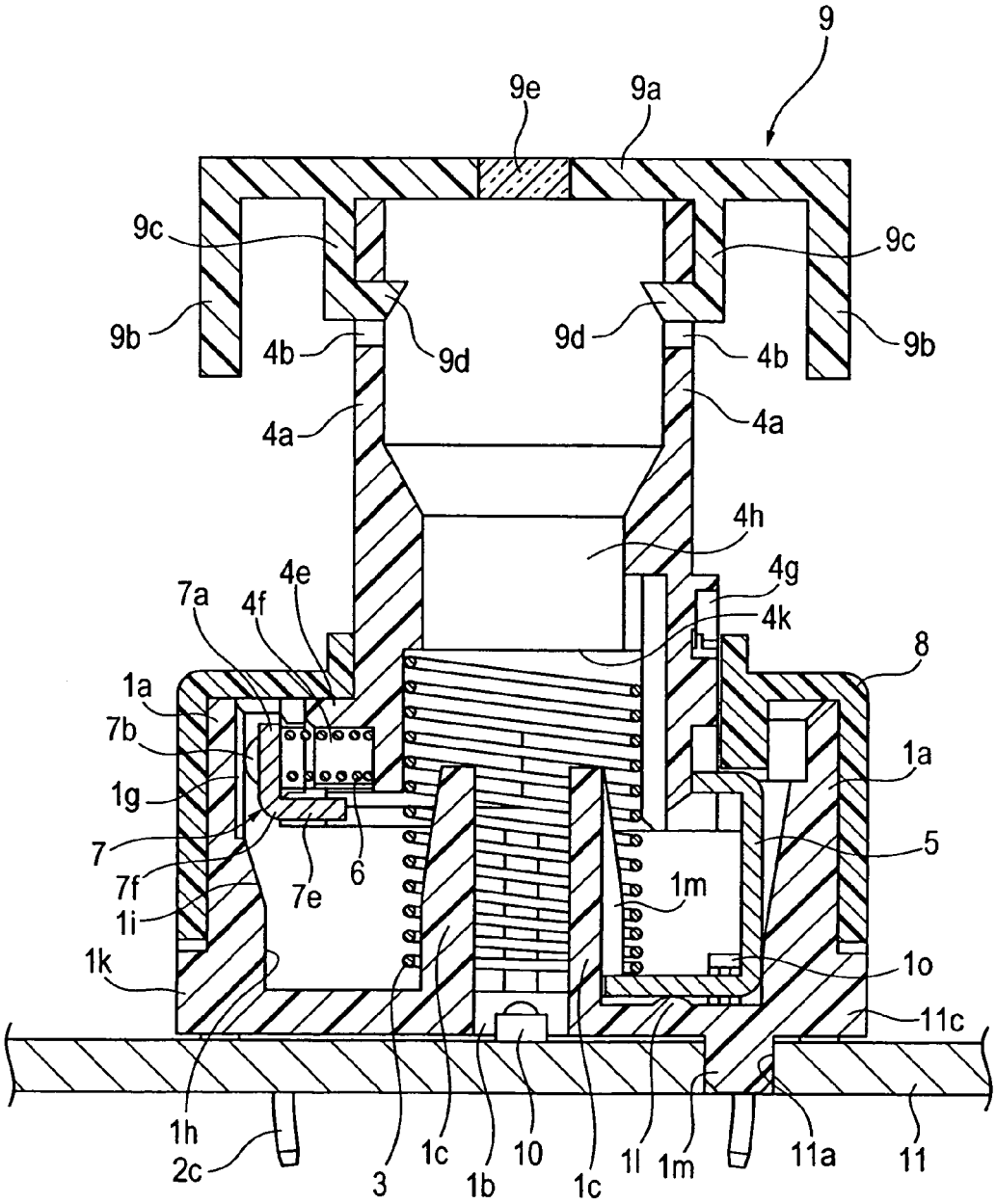
FIG. 3 is a cross-sectional view taken along line III—III in FIG. 1 of a push switch including a knob.
Figure 4:
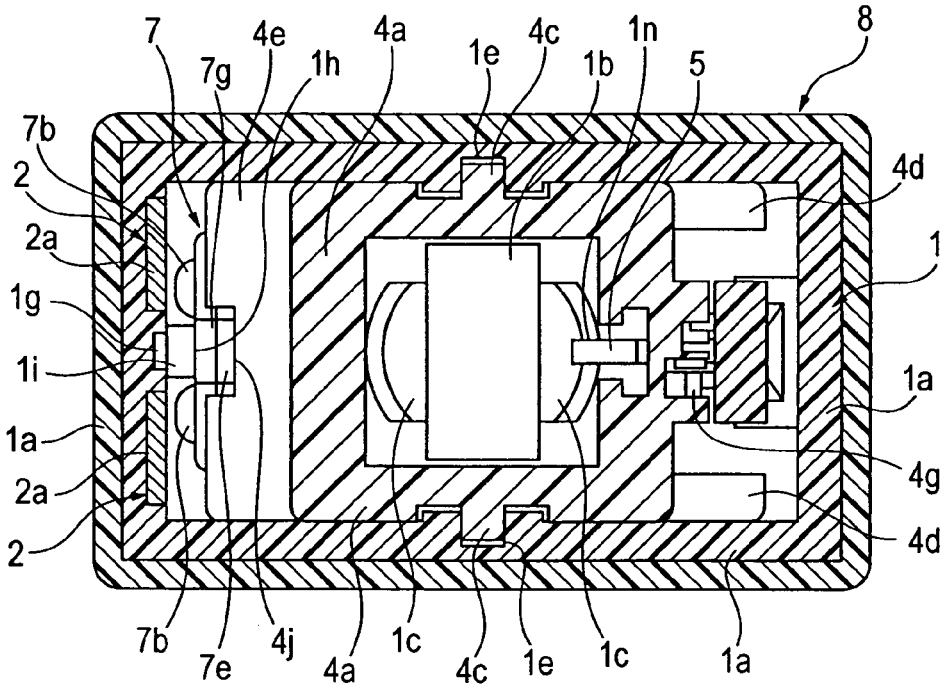
FIG. 4 is a cross-sectional view taken along line IV—IV in FIG. 2.
Figure 5:
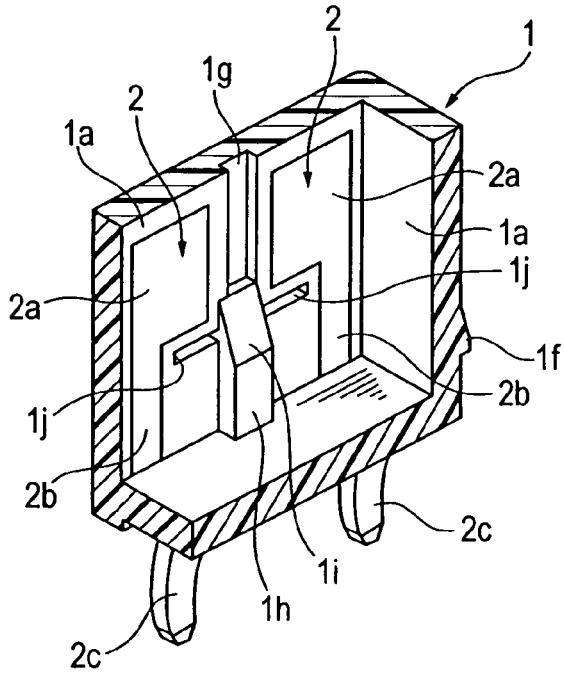
FIG. 5 is schematic view of the vicinity of a fixed contact of a case of a push switch according to an embodiment of the present invention.
Figure 6:
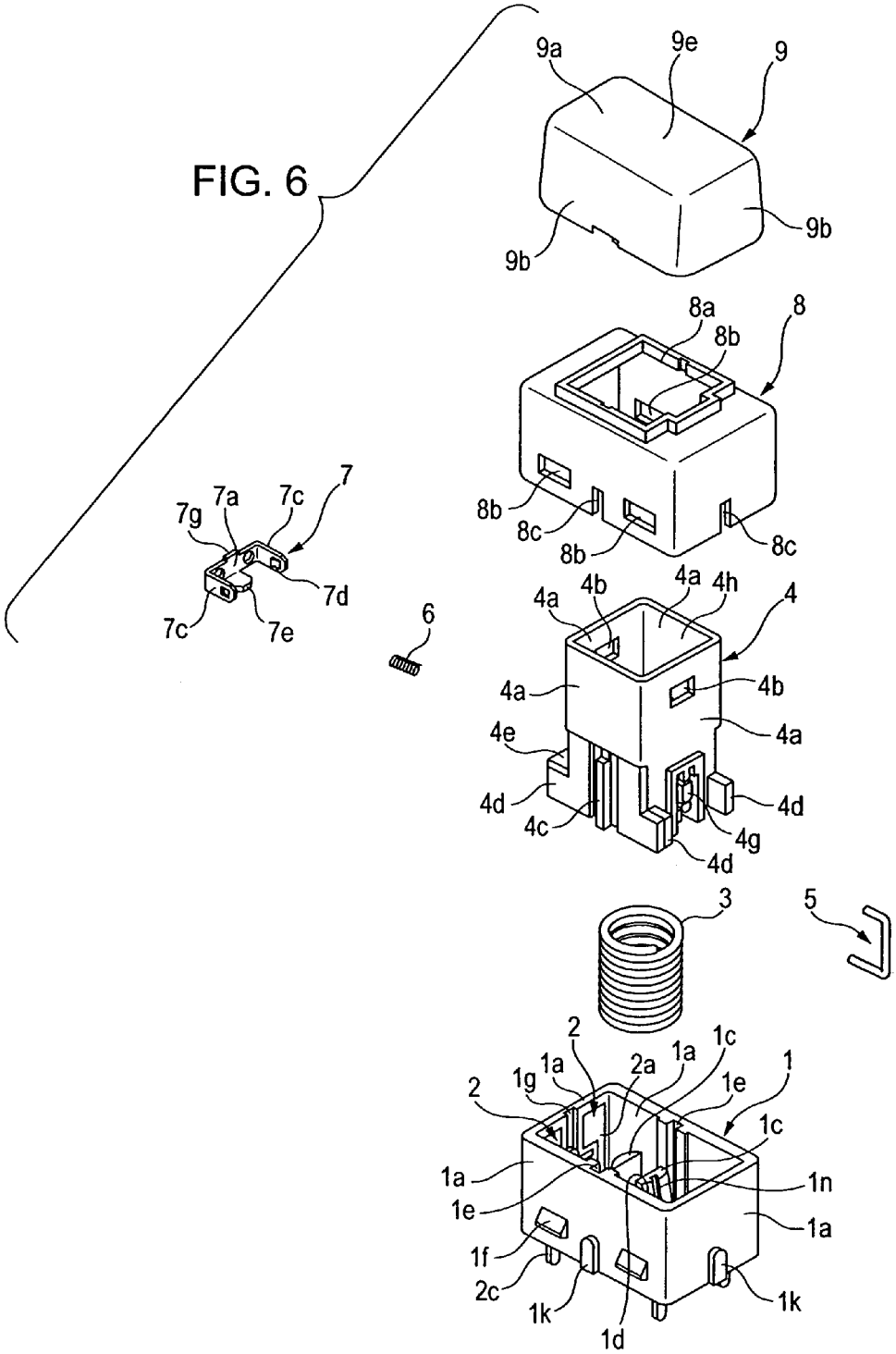
FIG. 6 is a perspective view of a push switch according to an embodiment of the present invention.
Figure 7:
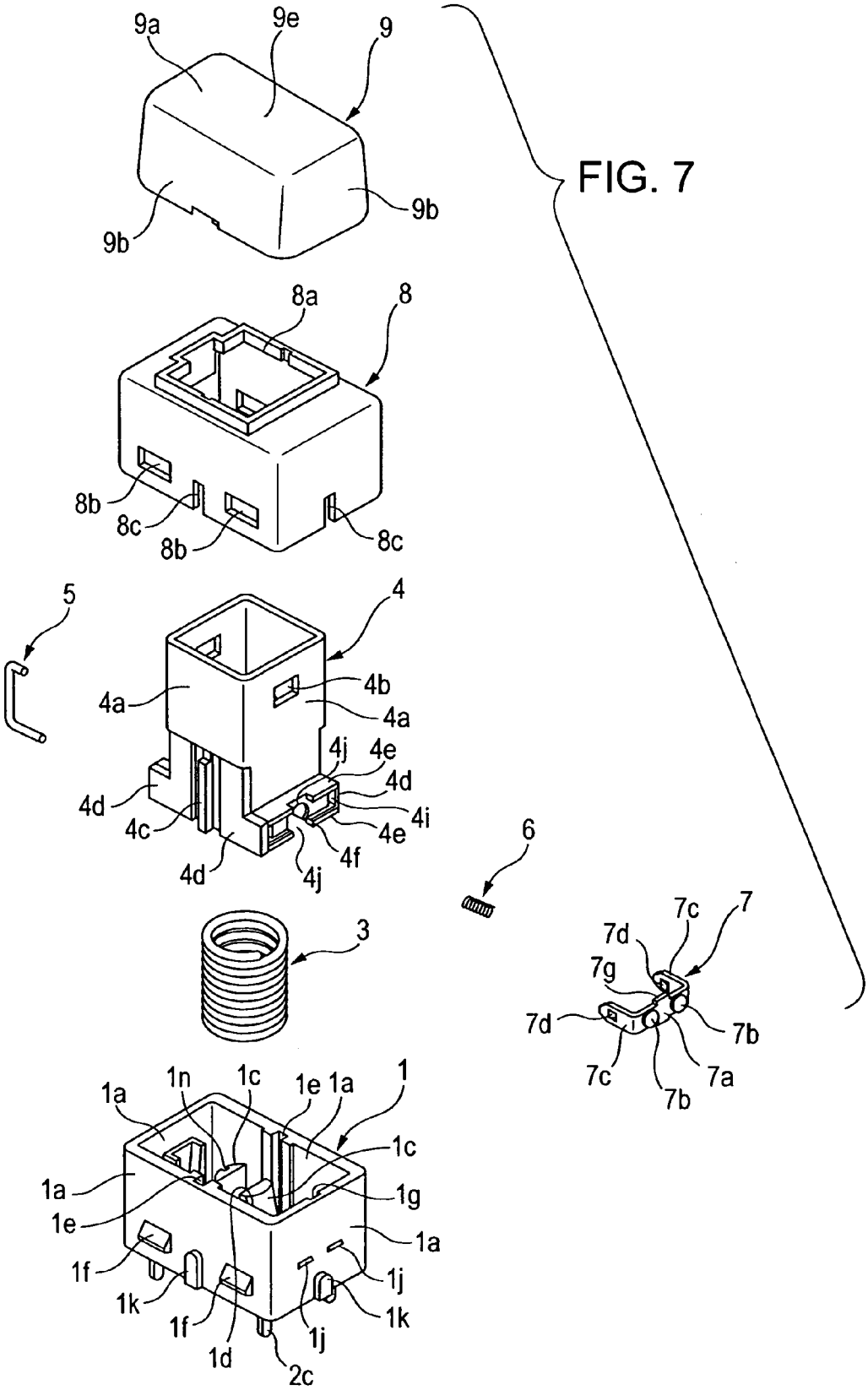
FIG. 7 is a perspective view of the push switch illustrated in FIG. 6 viewed from the back side.
Figure 8:
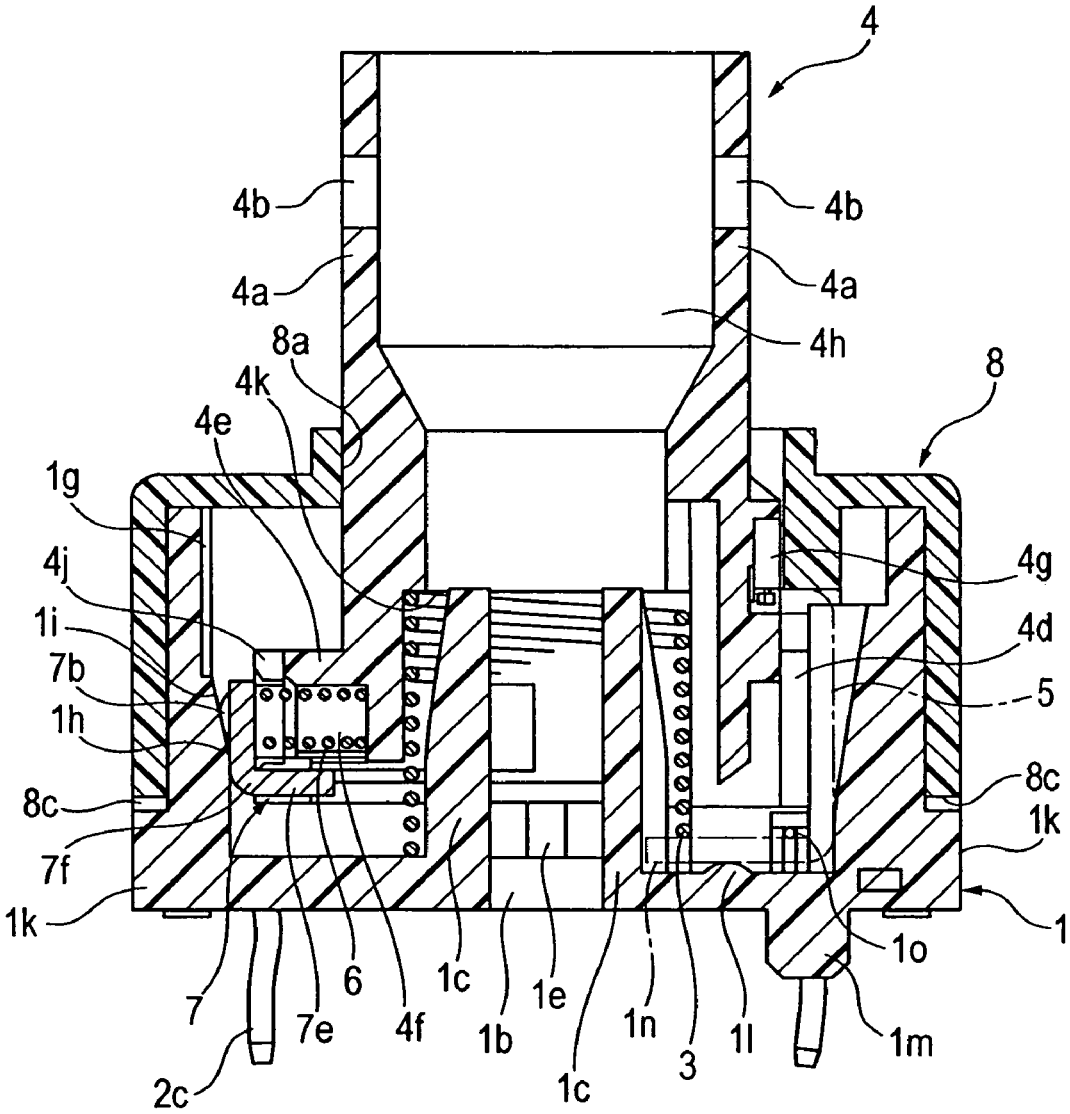
FIG. 8 is a cross-sectional view of a push switch according to an embodiment of the present invention wherein a knob is pressed down.
Figure 9:
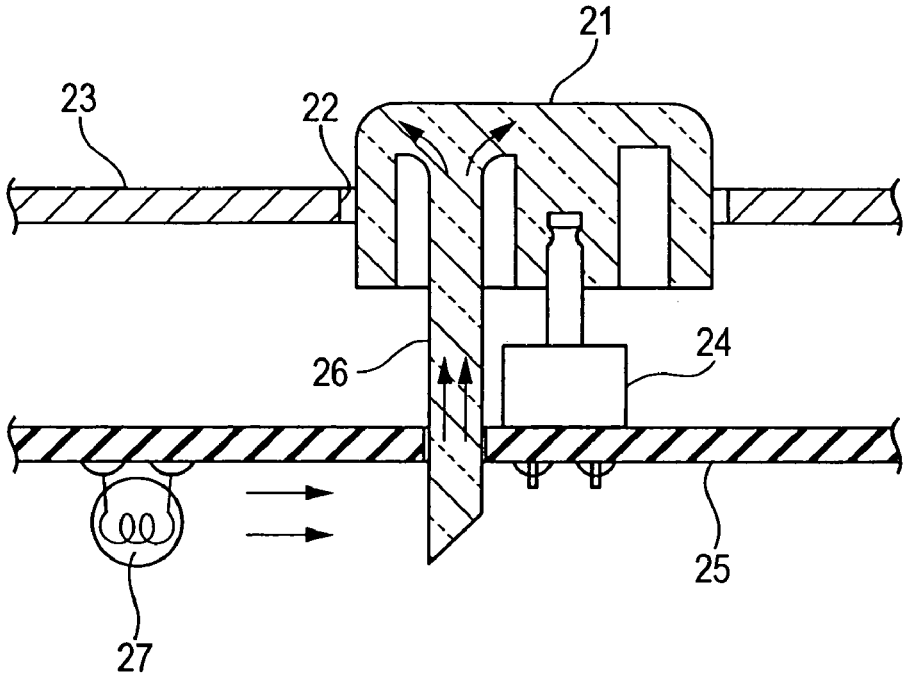
FIG. 9 PRIOR ART
FIG. 9 is a cross-sectional view of a known push switch.

The drawings referred to for describing the push switch according to an embodiment are as follows: FIG. 1 is a plan view of the push switch according to an embodiment; FIG. 2 is a front view of the push switch illustrated in FIG. 1; FIG. 3 is a cross-sectional view taken along line III—III in FIG. 1; FIG. 4 is a cross-sectional view taken along line IV—IV in FIG. 2; FIG. 5 is a schematic view of the vicinity of fixed contacts of a case of the push switch according to an embodiment; FIG. 6 is a perspective view of the push switch according to an embodiment; FIG. 7 is a perspective view from the back side of the FIG. 6; and FIG. 8 is cross-sectional view of the push switch according to an embodiment wherein a knob is pressed down.

As illustrated in FIGS. 1 to 8, the push switch according to an embodiment includes a case 1. The case 1 is made of synthetic resin and is produced by a molding process. The case 1 includes sidewalls 1*a* forming the four sides of the case 1, a rectangular insert hole 1*b* formed at the center of the bottom surface of the case 1, two return spring guiding protrusions 1*c* vertically disposed on the bottom surface opposite each other across the insert hole 1*b*, an opening 1*d* at the upper portion of the sidewalls 1*a*, guiding grooves 1*e* formed on the inner surface of the sidewalls 1*a*, and latching protrusions 1*f* formed on the outer surface of the sidewalls 1*a*. Two fixed contact units 2 are fixed on the inner side of one of the sidewalls 1*a*. A guiding depression 1*g* is interposed between the two fixed contact units 2. As illustrated in FIG. 5, the guiding depression 1*g* extends from the upper edge to the center of the sidewall 1*a*. Continuing from the guiding depression 1*g* at the center of the sidewall 1*a*, a contact guiding portion 1*h* extends to the bottom surface. The upper edge of the contact guiding portion 1*h* has an inclined surface 1*i* that extends to the guiding depression 1*g*. Grooves 1*j* for collecting abrasion dust extend horizontal from both sides of the inclined surface 1*i*, as illustrated in FIG. 5. Positioning protrusions 1*k* are provided to position an upper case 8 when the case 8 is assembled. A support point 11 protrudes from the bottom surface of the case 1 to support a lock pin 5 so that the lock pin 5 can pivot, as described below. A positioning protrusion 1*m* protrudes from the lower surface of the bottom of the case 1 to position the case 1 on a printed circuit board 11 when the case 1 is attached on the printed circuit board 11. A guiding groove 1*n* is provided on the return spring guiding protrusions 1*c*.

The upper case 8 covers the case 1 so that the opening 1*d* is covered. The lower surface of the upper case 8 is a square box having an unclosed bottom. The upper case 8 has an opening 8*a* on the upper surface, latch holes 8*b* for latching the latching protrusions 1*f* on the side surface, and positioning slits 8*c* for inserting the positioning protrusions 1*k*.

The fixed contact units 2 are composed of pressed metal plates and are provided as a single piece with the case 1. Fixed contacts 2*a* of the fixed contact units 2 are disposed at the upper portion, as illustrated in FIG. 5, on both sides of the guiding depression 1*g* along the inner surface of the sidewall 1*a* and above the grooves 1*j*. Thin bases 2*b* extend from the lower edges of the fixed contacts 2*a* downward to the bottom surface. The bases 2*b* are passed around the bottom of the case 1 and connect to terminals 2*c* extending vertically from bottom of the case 1.

A return spring 3 is composed of a metal wire formed into a coil. The return spring 3 may be a coil spring. The return spring 3 is disposed inside the case 1 so that the inner circumference of one end comes into contact with the return spring guiding protrusions 1*c* on the bottom surface of the case 1.

An operation shaft 4 is composed of synthetic resin. The operation shaft 4 has four sidewalls 4*a* shaped substantially into a square cylinder having a through-hole 4*h*. Engagement holes 4*b* for engaging a knob 9 are formed at the upper portion of the sidewalls 4*a*.

From the outer lower portion of two opposing sidewalls 4*a* among the four sidewalls 4*a*, two guides 4*c* protruding outwards are disposed along the operating direction of the push switch. The operation shaft 4 also includes guiding pieces 4*d* protruding from the lower edges of the same two sidewalls 4*a*.

On one of the other two opposing sidewalls 4*a*, a circular storage hole 4*f* for storing a resilient member 6 is formed substantially in the center of the lower outer surface of the sidewall 4*a*. On the other opposing sidewall 4*a*, a heart cam 4*g* is provided on outer lower surface.

Walls 4*e* are interposed between the upper and lower edges of the pair of guiding pieces 4*d* protruding from the sidewall 4*a* having the storage hole 4*f*. The storage hole 4*f* is surrounded by the guiding pieces 4*d* and the walls 4*e* to form a storage depression 4*i* for attaching and storing an attachment portion 7*c* of a movable contact unit 7. Guiding notches 4*j* are provided on the walls 4*e* to guide the movable contact unit 7.

The lower portion of the operation shaft 4 is stored in the case 1 and the upper portion protrudes upwards from the opening 8*a* of the upper case 8. At this time, the return spring 3 is interposed between a positioning shoulder 4*k* and the return spring guiding protrusions 1*c* of the case 1. The positioning shoulder 4*k* is formed at the lower portion of the through-hole 4*h* of the operation shaft 4 and function together with the peripheral sidewalls 4*a* to positions the return spring 3. The resilient force of the return spring 3 urges the operation shaft 4 in its axial direction. In this state, the operation shaft 4 is disposed so that it is movable against the projecting force of the resilient member 6 in the axial direction.

The lock pin 5 is composed of a metal wiring and is pressed in to a U-shape. A first end of the lock pin 5 is supported by the support point 11 on the bottom of the case 1 in a manner such that the lock pin 5 can pivot. The first end of the lock pin 5 is engaged with the guiding groove 1*n* of the return spring guiding protrusions 1*c* of the case 1. A second end of the lock pin 5 is inserted in a cam groove of the heart cam 4*g*. Since the second end is urged downwards by the first end engaged with the guiding groove 1*n* of the return spring guiding protrusions 1*c*, the lock pin 5 is urged in a counterclockwise direction, in FIG. 3, around the support point 11. The second end is pushed down so that it does not disengage from the cam groove of the heart cam 4*g*. In this way, the second end of the lock pin 5 moves along the cam groove of the heart cam 4*g* as the operation shaft 4 moves. The movement of the lock pin 5 guides the operation shaft 4 to move along a predetermined trajectory. A support 1*o* clips the first end of the lock pin 5. The support 1*o* enables the lock pin 5 to pivot around the support point 11 and enables the second end of the lock pin 5 to rotate by following the cam groove of the heart cam 4*g*. The heart cam 4*g* and the lock pin 5 enable the push operation of the push switch.

The resilient member 6 is composed of a coiled metal wire. The resilient member 6 may be a coil spring. The resilient member 6 is passed through and stored in the storage hole 4*f* of the sidewall 4*a* of the operation shaft 4 and is supported by the movable contact unit 7 and the sidewall 4*a* defining the storage hole 4*f*. The resilient member 6 is disposed in a manner such that it is resiliently deformed in a direction orthogonal to the axial direction of the operation shaft 4.

The movable contact unit 7 is composed of a pressed metal plate and includes a flat, rectangular base 7*a*, two semi-spherical movable contacts 7*b* being disposed apart from each other and protruding from one side of the base 7*a*, a pair of attachment portions 7*c* extending orthogonal to the base 7*a* from edge of the short sides of the base 7*a*, hooks 7*d* for preventing the movable contact unit 7 from being disengaged that are provided on the inner side of the tips of the attachment portions 7*c*, and a slidable piece 7*e* extending orthogonal to the base 7*a* from the lower edge of the long side of the base 7*a*. The slidable piece 7*e* is formed by bending the base 7*a* orthogonally at a bended portion 7*f*. Since the bended portion 7*f* forms an arc, the movable contact unit 7 can slide along the inclined surface 1*i* smoothly. At the center of the upper edge of the base 7*a*, a protrusion 7*g* is formed.

A first end of the resilient member 6 is urged against the center of a first surface of the base 7*a* of the movable contact unit 7. The base 7*a* is position so that it opposes the sidewall 4*a* having the storage hole 4*f* of the operation shaft 4. At this time, the attachment portions 7*c* are stored and supported inside the storage depression 4*i* so that the attachment portions 7*c* are moveable in a predetermined stroke in a direction orthogonal to the axial direction of the operation shaft 4. The slidable piece 7*e* and the protrusion 7*g* are engaged with the guiding notches 4*j*. In this state, the two movable contacts 7*b* are urged in a direction away from the sidewall 4*a* of the operation shaft 4 by the resilient force of the resilient member 6.

The two movable contacts 7*b* are urged against the fixed contacts 2*a* of the fixed contact units 2. The switch structure is constituted by the movable contact unit 7, the fixed contact units 2, the inclined surface 1*i*, and the contact guiding portion 1*h*.

The knob 9 is composed of synthetic resin and includes a substantially rectangular upper wall 9*a*, four sidewalls 9*b* vertically disposed from the circumference of the upper wall 9*a*, and a pair of attachment portions 9*c* extending inwards (in the axial direction) from the central area of the upper wall 9*a*. A pair of latch pieces 9*d*, which are engaged with the pair of engagement holes 4*b* of the operation shaft 4, protrudes from the lower ends of the attachment portions 9*c*.

A display portion 9*e* is provided on the surface of the upper wall 9*a*. For example, a graphical sign or a character is printed on the display portion 9*e*. The display portion 9*e* is illuminated by a light source 10. The operation shaft 4 and the knob 9 constitute an operating body.

The display portion 9*e* of the knob 9 is formed on the upper edge of the through-hole 4*h* of the operation shaft 4. The insert hole 1*b* is formed on the bottom surface of the case 1 opposite to the through-hole 4*h*. The return spring 3 is interposed between the case 1 and operating body (i.e., the operation shaft 4 and the knob 9), and more detail, the return spring 3 is interposed between the return spring guiding protrusions 1*c* and inner surface of the operating body around through-hole 4*h*. The through-hole 4*h* is formed linearly along the push direction the operating body with a diameter larger than the return spring guiding protrusions 1*c*, which are formed around the light source 10, and the return spring 3. In this way, the light source 10 does not comes into contact with other components and interfere with the push operation. Consequently, the display portion 9*e* can be efficiently illuminated with light from the light source 10 disposed at the insert hole 1*b* formed on the bottom surface of the case 1 without requiring a special light-guiding material and without interfering with the light path. Accordingly, the light source 10 and the display portion 9*e* can be disposed closely in a simple structure. Moreover, since the light source 10 and the display portion 9*e* can be disposed closely to each other, the display portion 9*e* can be illuminated efficiently. Furthermore, since the return spring 3 can be stored in the through-hole 4*h* of the operating body, the diameter of the push switch can be reduced.

The light source 10 is installed on the printed circuit board 11, disposed inside the insert hole 1*b* of the case 1, and illuminates the display portion 9*e* of the knob 9 disposed above the light source 10. The printed circuit board 11 includes a through-hole (not shown in the drawings) for inserting the terminals 2*c* and an engagement hole for engaging the positioning protrusion 1*m* of the case 1. The light source 10 may be a light-emitting diode (LED). Since LEDs are highly directional, the display portion 9*e* disposed at the upper edge of the insert hole 1*b* can be illuminated efficiently by matching the direction of the LED of the light source 10 with the axis of the insert hole 1*b*.

Next, the operation of the push switch according to an embodiment of the present invention will be described.

As illustrated in FIG. 3, the operation shaft 4 is urged upwards by the resilient force of the return spring 3, the guiding pieces 4*d* are retained at a position in which the operation shaft 4 are in contact with the lower peripheral edge of the opening 8*a* of the upper case 8. The movable contact unit 7 is urged to the left by the resilient force of the resilient member 6, and the two movable contacts 7*b* are pushed against the fixed contacts 2*a* of the fixed contact units 2 on the sidewalls 1*a* of the case 1. In this way, the push switch is turned on. At this time, the second end of the lock pin 5 is located at the lower end of the cam groove of the heart cam 4*g*.

First, when pressure is applied to the knob 9 (i.e., push operation is carried out), the knob 9 and the operation shaft 4 are pressed down against the resilient force of the return spring 3. The push operation causes the operation shaft 4 to be pushed into the upper case 8 and the case 1. When the operation shaft 4 is pushed into the case 1, the two movable contacts 7*b* of the movable contact unit 7 urged against the fixed contacts 2*a* of the fixed contact units 2 slight downwards on the fixed contacts 2*a*. As the movable contact unit 7 including the movable contacts 7*b* slides downwards, the slidable piece 7*e* of the movable contact unit 7 comes into contact with the inclined surface 1*i*. At this time, first, the bended portion 7*f* comes into contact with the inclined surface 1*i* and slides on the inclined surface 1*i*. Then, as illustrated in FIG. 8, the movable contact unit 7 gradually moves to the right against the resilient force of the resilient member 6, and the movable contacts 7*b* of the movable contact unit 7 moves away from the fixed contacts 2*a*. As a result, the push switch is turned off. In other words, the movable contacts 7*b* of the movable contact unit 7 slides within an area in which the fixed contacts 2*a* are provided and moves apart from the fixed contacts 2*a* in the area near the lower edge. As the operation shaft 4 moves further downwards, the slidable piece 7*e* of the movable contact unit 7 moves from the inclined surface 1*i* to the contact guiding portion 1*h*. In this state, the movable contacts 7*b* have not moved apart from the fixed contacts 2*a* and the movable contact unit 7 is not disposed at the sidewall 1*a* opposite the fixed contacts 2*a*. Accordingly, the push switch is reliably turned off.

The push switch is reliably turned off when the movable contacts 7*b* are at the off position because even if one of the movable contact 7*b* of the movable contact unit 7 is in contact with the fixed contacts 2*a*, the other movable contact 7*b* moves away from the fixed contacts 2*a* because the contact guiding portion 1*h* functions as a supporting point of the see-saw movement of the movable contact unit 7. Since, at this time, no bending load is applied to the contacting area of the movable contact unit 7 and the contact guiding portion 1*h*, the base 7*a* will not bend and will not come into contact with the fixed contacts 2*a* even when the thickness of the movable contact unit 7 reduced.

One of the ends of the lock pin 5 is pushed downwards by the resilient force of the return spring 3 and, thus, is urged in a counterclockwise direction around the support point 11. Therefore, the other end of the lock pin 5 is pushed against the cam groove of the heart cam 4*g* of the sidewall 4*a* of the operation shaft 4. Accordingly, the other end of the lock pin 5 moves inside the cam groove of the heart cam 4*g* along a predetermined trajectory. In other words, when the state of the push switch is changed from the state illustrated in FIG. 3 to the state illustrated in FIG. 8, the other end of the lock pin 5 is supported by the latch of the cam groove of the heart cam 4*g*. Therefore, even when the pressured applied to the knob 9 is released, the operation shaft 4 is locked at a pushed-in position, as illustrated in FIG. 8.

Subsequently, when the knob 9 is pushed again in the state illustrated in FIG. 8, the knob 9 and the operation shaft 4 are pushed down slightly more and the second end of the lock pin 5 is disengaged from the cam groove of the heart cam 4*g*. Then, after the pressure applied on the knob 9 is released, the knob 9 and the operation shaft 4 return to their original positions, as illustrated in FIG. 3, by the resilient force of the return spring 3. At this time, as the operation shaft 4 moves upwards, the movable contact unit 7 also moves upwards and the attachment portions 7*c* of the movable contact unit 7 disposed above the contact guiding portion 1*h* of the case 1 slide on the contact guiding portion 1*h* and reach the inclined surface 1*i*. The bended portion 7*f* slides and moves smoothly on the inclined surface 1*i*. The bended portion 7*f* of the movable contact unit 7 slides down the inclined surface 1*i* due to the resilient force of the resilient member 6. The movable contacts 7*b* of the movable contact unit 7 move upwards and gradually approach and come into contact with the bases 2*b*. In this way, the push switch is turned on.

The push switch according to this embodiment includes the operating body (i.e., the through-hole 4*h* and the knob 9), the case 1, the return spring 3, and the light source 10. The operating body is controlled by push operation, has the through-hole 4*h* in the center and the display portion 9*e* at the upper edge of the through-hole 4*h*, and supports a movable contact unit 7. The case 1 has the insert hole 1*b* on the bottom surface opposing the through-hole 4*h* and the fixed contact units 2 on an inner surface of the sidewall 1*a*. The movable contact unit 7 comes into contact with and are separated from the fixed contact units 2. The return spring 3 is interposed between the case 1 and the operating body and moves back the operating body in the reverse direction of the push operation. The light source 10 is stored in the insert hole 1*b* of the case 1 and the through-hole 4*h* of the operating body. The through-hole 4*h* is formed linearly in the movement direction the operating body during the push operation to prevent the light source 10 from interfering with the operating body. In this way, the push switch can have a simple structure wherein the display portion 9*e* and the light source 10 are disposed closely to each other. Furthermore, since the light source 10 can be disposed close to the display portion 9*e*, the display portion 9*e* can be illuminated efficiently. Moreover, since the return spring 3 is stored in the through-hole 4*h* of the operating body, the diameter of the push switch can be reduced.

The case 1 includes the return spring guiding protrusions 1*c* in the periphery of the insert hole 1*b*. A first end of the return spring 3 is guided to the periphery of the return spring guiding protrusions 1*c*. The operating body includes the sidewalls 1*a* defining the through-hole 1*b* at the periphery of the return spring 3 and the positioning unit 1*k* for positioning a second end of the return spring 3 in the through-hole 1*b*. In this way, the return spring 3 can be guided easily. Furthermore, since the return spring 3 is stored in the through-hole 4*h* of the operating body, the diameter of the push switch can be reduced.

The push switch according to this embodiment includes a switch mechanism (i.e., the fixed contact units 2 and the movable contact unit 7) and a push lock mechanism (i.e., the heart cam 4*g* and the lock pin 5). The switch mechanism is provided on one of the sidewalls 4*a* of the operating body. The push lock mechanism is disposed on another one of the sidewalls 4*a* of the operating body opposing the sidewalls 4*a* including the switching mechanism across the through-hole 4*h*. Therefore, the overall size of the push switch can be reduced.

The operation shaft 4 and the knob 9 of the push switch according to this embodiment are substantially square prisms. However, the operation shaft 4 and the knob 9 are not limited and, instead, may be a cylinder or a polygonal cylinder.

In Japanese Unexamined Patent Application Publication No. 63-168932, the function of the blades 38*d* is not clearly specified. A known structure of the blades 38*d* and the vicinity, as illustrated in FIGS. 10 and 11, is considered below.

Figure 10:
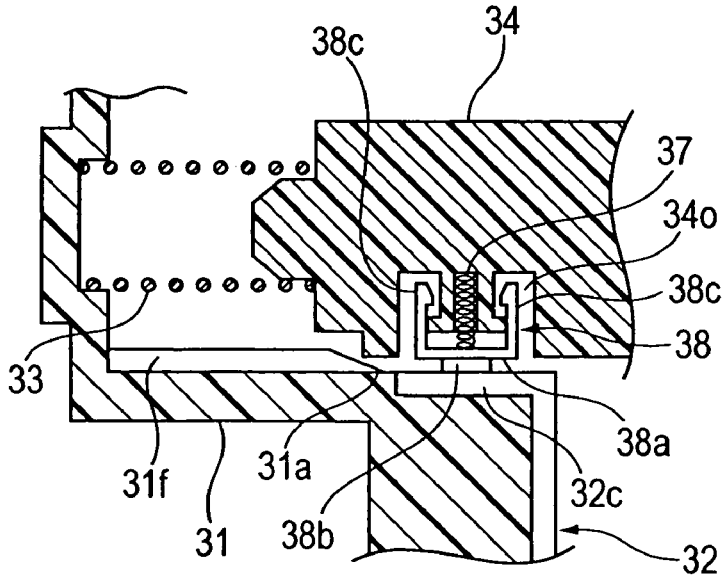
FIG. 10 is a schematic view of a known structure of a movable contact.
Figure 12:
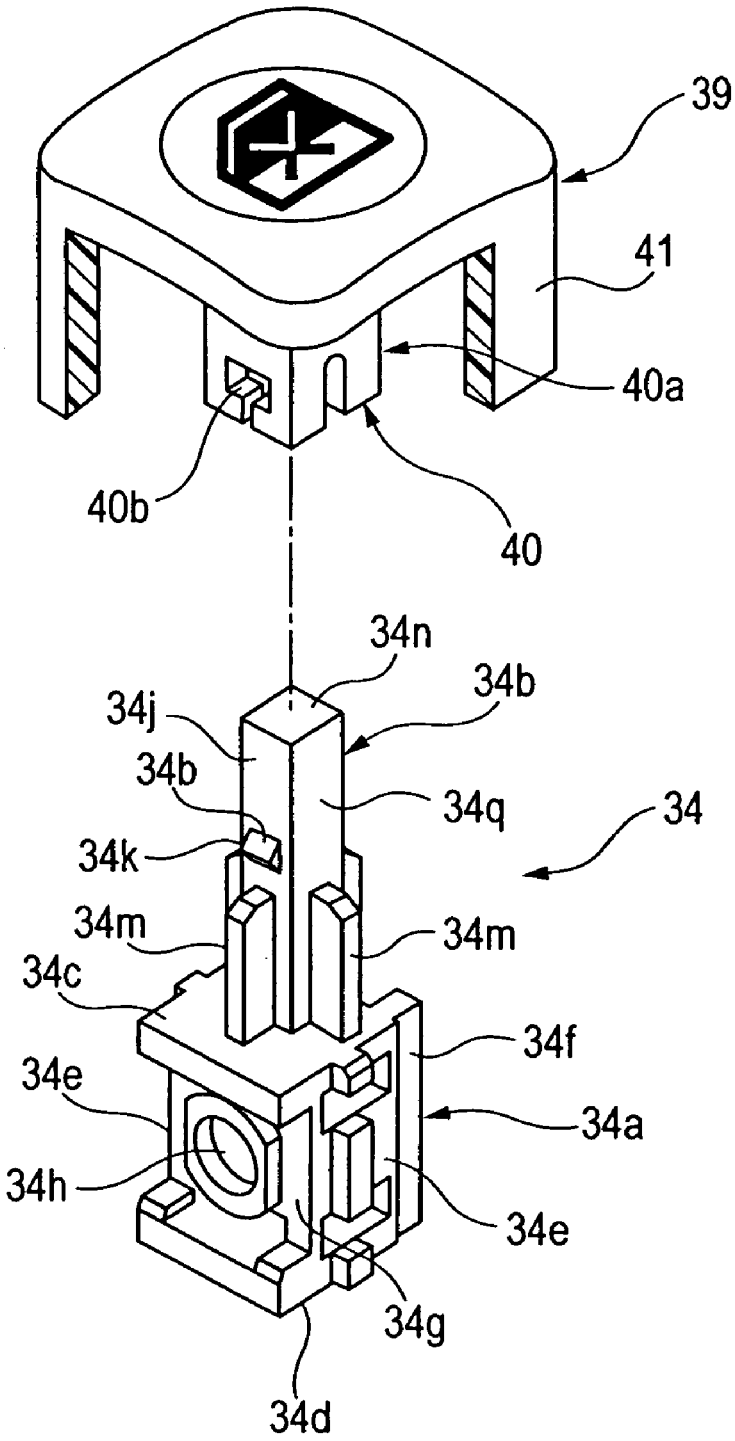
FIG. 12 PRIOR ART
FIG. 12 is a perspective view of a known push switch with the knob cut away.
Figure 13:
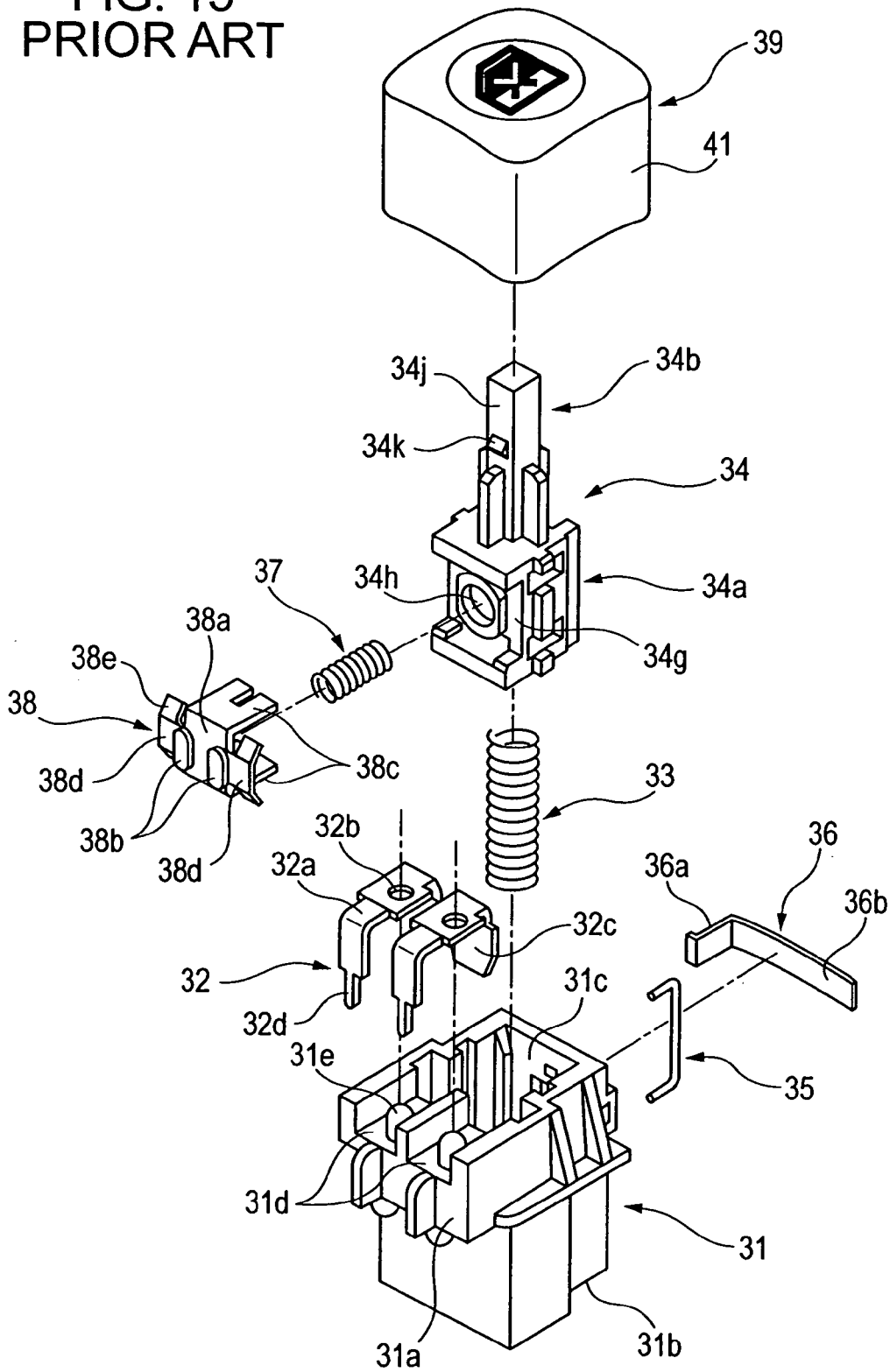
FIG. 13 PRIOR ART
FIG. 13 is a perspective view of the entire push switch illustrated in FIG. 12.

FIG. 10 is a schematic view illustrating a known structure of a movable contact mechanism. FIG. 11 is an exploded perspective view of FIG. 10. The components that are the same as those illustrated in FIGS. 12 and 13 are represented by the same reference numerals.

Figure 11:
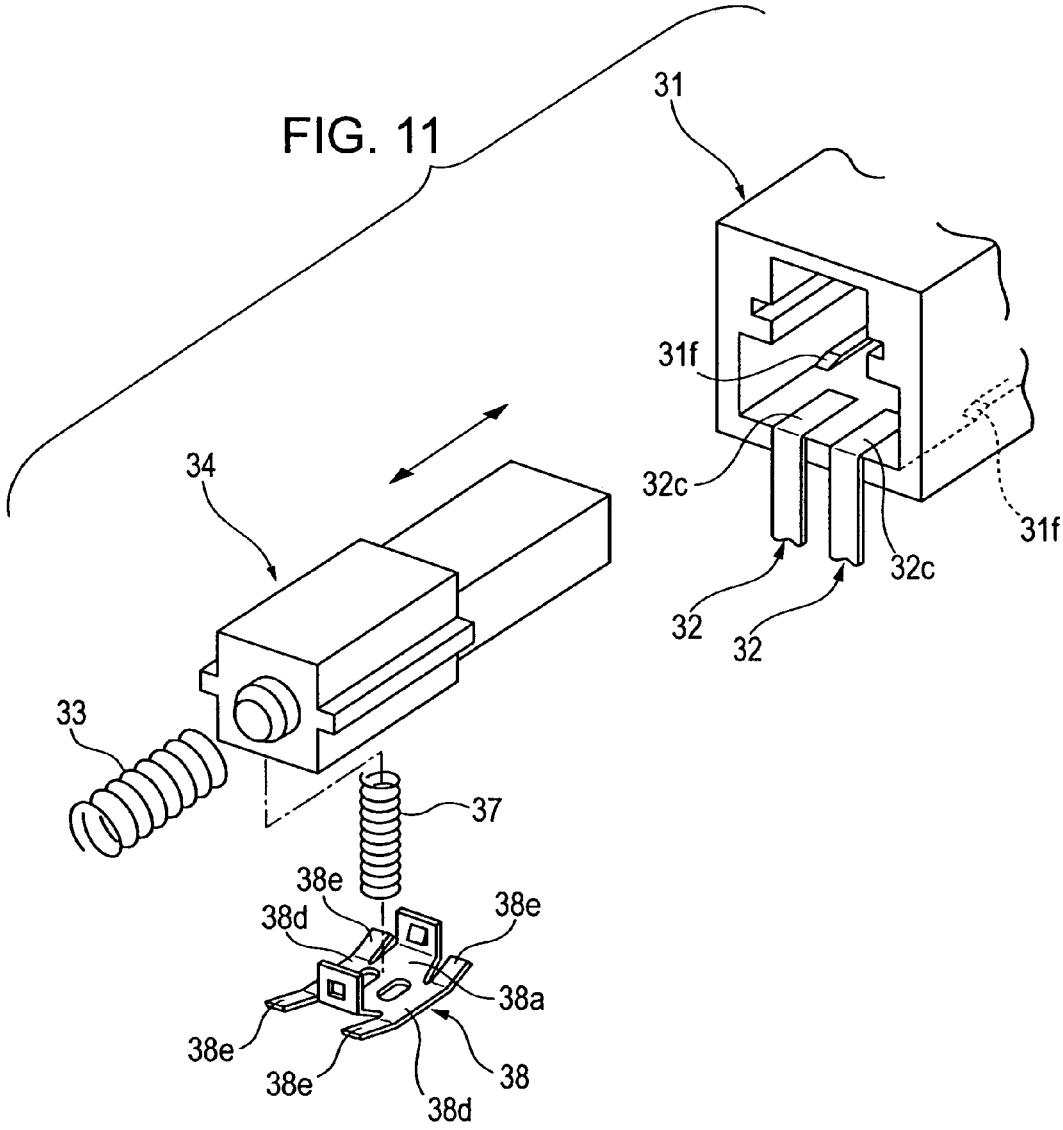
FIG. 11 is an exploded perspective view of FIG. 10.

According to the known structure, as illustrated in FIGS. 10 and 11, at the base 38*a* of the movable contact unit 38 includes the pair of attachment portions 38*c* engaged with an attachment hole 34*o* of the movable unit 34 in the movement direction of the movable unit 34. The blades 38*d* are provided at the edges of the base 38*a* of the movable contact unit 38 in a direction orthogonal to the movement direction of the base 38*a*. The guiding pieces 38*e* are provided at the edges of the blades 38*d* in the movement direction, as illustrated in FIG. 11, at an angle inclining upwards.

Guiding bumps 31*f* protrude from the further ends of the sidewalls 31*a* including the fixed contacts 32*c* of the case 31.

When the movable unit 34 is pushed while the push switch is turned on, as illustrated in FIG. 10, the movable unit 34 moves leftwards against the return spring 33. Accordingly, the movable contacts 38*b* pushed by the fixed contacts 32*c*, which is pushed by the return spring 33, slide to the left. When the movable unit 34 is pushed further, the guiding pieces 38*e* of the blades 38*d* contact the guiding bumps 31*f*. The blades 38*d* slide on the guiding bumps 31*f*. As a result, the movable contact unit 38 separates from the fixed contacts 32*c* and the inner surface of the sidewall 31*a* in a direction against the resilient force of the resilient member 37. Accordingly, the push switch is turned off.

The differences in the above-described known structure and the above-described embodiment are described below.

According to the known structure, since the blades 38*d* are provided on both sides (in the direction of the push operation) of the base 38*a* of the movable contact unit 38, the attachment portions 38*c* are provided in the direction orthogonal to the blades 38*d*. For this reason, when the knob 39 is illuminated from the bottom (from the left in FIG. 10), the attachment portions 38*c* may interfere with the light path and/or the through-hole in the movable unit 34.

According to the above-described embodiment, the center of the base 7*a* of the movable contact unit 7 contacts the contact guiding portion 1*h* of the case 1. Since the attachment portions 7*c* are provided on both sides of the movable contact unit 7 in the direction orthogonal to the push direction of the base 7*a*, the through-hole 4*h* passing through the center of the operation shaft 4 can be provided. In this way, the attachment portions 7*c* do not interfere with the insertion of the cylindrical return spring 3 or with the return spring guiding protrusions 1*c*. Consequently, the diameter of the insert hole 1*b* in which the light source 10 is disposed can be increased. If the return spring 3 and the return spring guiding protrusions 1*c* are not provided in these positions and the attachment portions 7*c* are provided without a member covering the upper portion of the light source 10, the light illuminating the display portion 9*e* is not blocked. Accordingly, the size of the illuminating push switch in the direction orthogonal to the movement direction of the movable unit 34 may be reduced. More specifically, according to the known structure, the surfaces of the attachment portions 38*c* are disposed on the center line of the movable unit 7. On the other hand, according to the above-described embodiment, the pair of attachment portions 7*c* is disposed at positions not on the center line of the movable unit 34. Therefore, the attachment portions 7*c* according to the above-described embodiment can be disposed in a manner such that the circular return spring 3 is interposed between the attachment portions 7*c* when viewed from the direction orthogonal to the movement direction of the movable unit 7 and such that the side surfaces of the attachment portions 7*c* face the movement direction. In the above-described embodiment, the slidable piece 7*e* is provided instead of the blades 38*d* according to the known structure at the same position as the attachment portions 38*c*. Since the slidable piece 7*e* only has to be guided over the contact guiding portion 1*h*, the slidable piece 7*e* does not have to protrude as much as the attachment portions 38*c*.

According to the known structure, since the blades 38*d* are provided on both side (in the push direction) of the base 38*a* of the movable contact unit 38, as described above, the attachment portions 38*c* are provided in the direction orthogonal to the push direction. Furthermore, two attachment portions 38*c* are required, causing the length of the movable unit 34 in the push direction to become long.

On the contrary, according to the above-described embodiment, the attachment portions 7*c* and the movable contacts 7*b* of the movable contact unit 7 are aligned in the push direction of the operation shaft 4 so that the attachment portions 7*c* and the movable contacts 7*b* overlap each other (so that they overlap in the vertical direction in FIG. 3). In this way, the length in the push direction is reduced. According to the above-described embodiment, one bended portions (bended portion 7*f*) is needed for smoothly sliding the movable contact unit 7 on the contact guiding portion 1*h*. However, according to the known structure, two bended portioned are required. Therefore, the size of the push switch according to the above-described embodiment is smaller in comparison with the push switch according to the known structure.

The blades 38*d* according to the known structure are disposed on the left and right of the base 38*a* of the movable contact unit 38. Therefore, the length of the direction orthogonal to the push direction of the movable unit 34 is reduced.

The center of the base 7*a* of the movable contact unit 7 according to the above-described embodiment is in contact with the resilient member 6. The base 7*a*, which is interposed between the pair of movable contacts 7*b*, is interposed between the resilient member 6 and the contact guiding portion 1*h*. Consequently, the length of the push switch in the direction orthogonal to the push direction of the movable unit 34 can be reduced and, at the same time, both of the movable contacts 7*b* can be completely separated from the fixed contacts 2*a*. In other words, failure of separation such as only one of the movable contacts 7*b* being separated from the fixed contacts 2*a* due to tilting of the movable contact unit 7 can be prevented.

According to the above-described embodiment, the contact guiding portion 1*h* in contact with the movable contact unit 7 for guiding the movable contact unit 7 protrudes from the area between the leads (base 7*a*) of the fixed contacts 2*a*, which are insulated and formed as a single piece with the case 1. Since the contact guiding portion 1*h* is provided in a free area that exists from the beginning, the length in the direction orthogonal to the push direction can be reduced.

The movable contacts 7*b* slides only on the fixed contacts 2*a* to prevent generation of abrasion dust due to sliding of the movable contacts 7*b*. In other words, the movable contacts 7*b* separate from the fixed contacts 2*a* from the middle of the metal plate constituting the fixed contacts 2*a* due to the contact guiding portion 1*h*.

According to the known structure, the pair of fixed contacts 32*c* is formed on a same plane.

According to the above-described embodiment, the projection constituting the contact guiding portion 1*h* is provided between the fixed contacts 2*a*, and the distance between the fixed contacts 2*a* is increased. In this way, the voltage endurance is increased.

The push switch according to the above-mentioned embodiment includes the operation shaft 4, the case 1, the movable contact unit 7, and the contact guiding portion 1*h*. The operation shaft 4 is capable of being reciprocated in the longitudinal direction when the push operation of the push switch is carried out. The case 1 includes a pair of the fixed contacts 2*a* extending parallel to each other in the direction of the push operation. The movable contact unit 7 is supported by the operation shaft 4 and includes a pair of protruding movable contacts 7*b* being urged against the pair of fixed contacts 2*a* by a resilient member. The contact guiding portion 1*h* is capable of separating the movable contacts 7*b* from the fixed contacts 2*a* by contacting the area between the protrusions when the push operation is carried out so as to turn off the push switch. Since the movable contacts 7*b* are separated from the fixed contacts 2*a* by contacting the area between the protrusions, blades are not required. Moreover, the movable contact unit 7 can be contacted with or separated from the fixed contacts 2*a* by push-operating the operation shaft 4, and the size of the push switch can be reduced.

In the push switch according to the above-mentioned embodiment, the area between the pair of movable contacts 7*b* is pushed by the resilient member 6. Therefore, when the entire movable contact unit 7 is pushed by the resilient member 6, the movable contact unit 7 cannot tilt as easily. Thus, there is a possibility in that an error in manufacturing may cause a difference in the height of the fixed contacts 2*a*, causing the movable contacts 7*b* not to be able to fully contact the fixed contacts 2*a*. However, as in the push switch according to the above-described embodiment, by pushing the area between the movable contacts 7*b* by the resilient member 6, or more specifically a coil spring having a small diameter, the movable contact unit 7 can be easily tilted and the movable contacts 7*b* can fully contact the fixed contacts 2*a*.

When the movable contacts 7*b* are at an off position, even if one of the movable contacts 7*b* of the movable contact unit 7 is in contact with one of the fixed contacts 2*a*, the other movable contact 7*b* will be separated from the other fixed contact 2*a* wherein the contact guiding portion 1*h* functions as a support point of the see-saw movement. In this way, the push switch is reliably turned off. At this time, bending load is not applied at the contact point of the movable contact unit 7 and the contact guiding portion 1*h*. Therefore, the thickness of the movable contact unit 7 may be reduced.

According to the above-described embodiment, the resilient member 6 pushes a point on the straight line connecting the movable contacts 7*b*. In this way, the length in the movement direction of the movable contacts 7*b* can be reduced. Since the movable contacts 7*b* are separated from the fixed contacts 2*a* according to the shape of the contact guiding portion 1*h*, the length in the movement direction can be reduced.

What is claimed is:

1. A push switch comprising:

an operating body controlled by push operation including a through-hole at a center and a display portion at an upper edge of the through-hole, the operating body supporting a movable contact unit;

a case having an insert hole on a bottom surface opposing the through-hole and a fixed contact unit on an inner surface, the fixed contact unit being contacted by and separated from the movable contact unit;

a return spring interposed between the case and the operating body, the return spring returning a position of the operating body in a reverse direction of the push operation; and a light source stored in the insert hole of the case and the through-hole of the operating body, wherein the through-hole is formed linearly in the push direction so that the light source does not interfere with the push operation when the operating body is pushed.

2. The push switch according to claim 1, wherein the case includes guiding protrusions in a periphery of the insert hole, wherein a first end of the return spring is guided to a periphery of the guiding protrusions, and wherein the operating body includes sidewalls disposed at a periphery of the return spring through the through-hole and a positioning unit for positioning by contacting a second end of the return spring in the through-hole.

3. The push switch according to claim 1, further comprising:

a switch mechanism including the movable contact unit and the fixed contact unit, the switch mechanism being provided on one of sidewalls of the operating body; and a push lock mechanism for the operating body, the push lock mechanism being disposed on another one of the sidewalls opposing said one of the sidewalls across the through-hole.

4. The push switch according to claim 3, wherein the fixed contact unit includes a pair of fixed contacts extending parallel to each other on the case and extending in the push operation direction, wherein the movable contact unit includes a pair of protrusions, the pair of protrusions being urged against the fixed contacts by a resilient member, and wherein the case includes a projection capable of separating the movable contacts from the fixed contacts by contacting an area between the pair of protrusions when a push operation moves the push switch to an off position.

5. A push switch comprising:

an operation shaft capable of being reciprocated in a longitudinal direction in accordance with a push operation;

a case including a pair of fixed contacts extending parallel to each other in a push operation direction;

a movable contact unit being supported by the operation shaft and including a pair of protrusions being urged against the pair of fixed contacts by a resilient member; and a contact guiding portion capable of separating movable contacts from the fixed contacts by contacting an area between the pair of protrusions when a push operation moves the push switch to an off position.

6. The push switch according to claim 5, wherein an area between a pair of the movable contacts is pushed by the resilient member.

7. The push switch according to claim 6, wherein an area on a straight line connecting the pair of movable contacts is pushed by the resilient member.

8. A push switch comprising:

an operation shaft capable of being reciprocated in a longitudinal direction in accordance with a push operation;

a case including a pair of fixed contacts extending parallel to each other in a push operation direction;

a movable contact unit supported by the operation shaft, the movable contact unit comprising a pair of protruding contacts disposed on a flat plate base in a direction orthogonal to the push operation direction, the pair of protruding contacts urged against the pair of fixed contacts by a resilient member; and a contact guiding portion capable of separating the protruding contacts from the fixed contacts by contacting an area between the pair of protruding contacts when a push operation moves the push switch to an off position.

* * * * *